United States Patent [19]

Willis

[11] 4,285,688

[45] Aug. 25, 1981

[54] SADDLE OIL

[75] Inventor: Monte B. Willis, Randolph, Utah

[73] Assignee: Leather Life, Inc., Randolph, Utah

[21] Appl. No.: 24,670

[22] Filed: Mar. 28, 1979

[51] Int. Cl.[3] ..... C14C 9/00

[52] U.S. Cl. ..... 8/94.1 R; 106/245; 424/312

[58] Field of Search ..... 106/245; 8/94.1 R

[56] References Cited

U.S. PATENT DOCUMENTS

| | | | |
|---|---|---|---|
| 994,446 | 6/1911 | Drake | 106/7 |
| 1,382,468 | 6/1921 | Bumpass | 106/7 |
| 2,776,268 | 1/1957 | Morrill | 260/23 |
| 3,408,319 | 10/1968 | Rau | 260/23 |

FOREIGN PATENT DOCUMENTS

| | | | |
|---|---|---|---|
| 8443 | of 1886 | United Kingdom | 106/245 |
| 17026 | of 1887 | United Kingdom | 106/245 |
| 22774 | of 1904 | United Kingdom | 106/245 |

*Primary Examiner*—C. A. Henderson

[57] ABSTRACT

A leather cleaning and preserving composition comprising 30–50 parts by weight of a non drying animal oil, 20–30 parts by weight of a non drying vegetable oil, 10–20 parts by weight of an animal fat, 5–10 parts by weight of a natural wax, and 5–10 parts by weight of a mineral or petroleum wax.

5 Claims, No Drawings

SADDLE OIL

BACKGROUND OF THE INVENTION

This invention relates to a composition for the cleaning and preservation of all leather goods. More particularly this invention relates to a composition for the cleaning and preservation of leather goods utilizing a combination of natural oils, natural wax and mineral waxes.

It is known to use various types of oils and waxes in the treatment of leather to maintain leather softness, improve resistance to water, and to improve or extend the life of the leather. For example, U.S. Pat. No. 14,832 claimed a composition for softening leather by stuffing it with a paste made of rye meal, beeswax, resin, molasses and cod oil. U.S. Pat. No. 578,413 claimed a leather dressing composition of Japan wax, paraffin oil, neat's foot oil, and beef oil. Other early patents relating to the treatment of leather are U.S. Pat. No. 381,680 and U.S. Pat. No. 383,511. The compositions claimed in these patents are useful in temporarily softening and preserving tanned leathers but require frequent application.

With the discovery of synthetic polymers and rubbers, various leather impregnating compositions were developed such as are disclosed in U.S. Pat. Nos. 2,093,421; 2,719,794 and 2,967,165. It has been noted when using compositions containing paraffin wax that blooming often occurs on the surface of the leather. On the other hand, formulations containing only natural waxes such as beeswax are often sticky and difficult to apply.

It is an object of the present invention to provide a leather treating composition which cleans and preserves leather.

It is also an object of the present invention to provide a composition for treating leather which is easy to apply, is rapidly absorbed and imparts a long life to the leather being treated.

A still further object of this invention is to provide a leather treating composition which is easily absorbed and contained by the leather thereby retaining the natural appearances and luster of the leather surface.

These and other objects may be accomplished by means of a composition comprising a multiplicity of natural oils, fats, natural waxes and mineral waxes as hereinafter described.

DETAILED DESCRIPTION OF THE INVENTION

It has now been discovered that leather goods such as saddles, boots, purses, chaps and the like may be cleaned and preserved by a novel composition comprising 30–50 parts by weight of a non drying animal oil or the equivalent in a synthetic oil, 20–30 parts by weight of a non drying vegetable oil, 10–20 parts by weight of an animal fat, 5–10 parts by weight of a natural wax and 5–10 parts by weight of a mineral or petroleum wax.

The most prevalent of the non drying animal oils is neat's foot oil. However, lard oil may also be used. Equivalent synthetic and petroleum based oils imparting the same non drying characteristics may also be used. A particularly useful oil is hydraulic oil marketed under the tradename SUNVIST by SunOil Company. Non drying animal oils are well known to be used for leather preservation treatment. However, these oils when used along have a tendency to cause leather to age and eventually rot. When utilized in the present composition these non drying animal oils may be present in amounts bearing from 30–50 parts by weight with amounts ranging from 35–45 parts being preferred.

Non drying vegetable oils of the olive oil class are preferred for use in this invention. Typical of these oils are almond oil, hazel nut oil, olive oil, peach kernel oil and peanut oil. The composition may contain a plurality of these non drying vegetable oils such as a mixture of peanut oil and olive oil. In general these oils are present in amounts ranging from 20–30% by weight of the overall composition. These oils not only contribute to the softening and cleaning of the leather but also serve as a vehicle for creating a homogenous mixture between the various oils, fats and waxes. A particularly preferred composition is one containing from 16–24 parts by weight of peanut oil and 4–6 parts by weight of olive oil.

Animal fats such as beef tallow, bone fat, mutton tallow and the like may be utilized to both soften and penetrate leather surfaces thereby imparting a waterproofing characteristic to such leathers. These animal fats are generally present in amounts ranging from 10–20 parts by weight. Beef tallow is particularly preferred because of its ready availability.

A variety of natural waxes are suitable to the present invention. These include insect waxes such as beeswax, animal waxes such as spermaceti and wool fat and vegetable waxes such as candelilla and carnauba. At least one of these waxes is used however if desired a combination of waxes may be employed. These waxes are present ranging in amounts of from 5–10 parts by weight. These waxes prevent the blooming that often occurs when paraffin waxes are used in combination with oils in leather treating compositions. These waxes are excellent water repellants as well as blending with mineral waxes and the various fats and oils making up the compositions of this invention.

The mineral waxes which may be used in this invention are those derived from petroleum and are generally classified as paraffin wax or as microcrystaline wax. Microcrystaline wax is also known as amorphous wax and is obtained by the dewaxing of residual lubricating oils while the paraffin waxes are usually obtained by the dewaxing of distillate lubricating oil fractions. Distillate paraffin waxes usually have melting points between about 120° F. and about 145° F., preferably between about 125° and 140° F. Microcrystalline waxes contain only minor amounts of normal paraffins and largely predominate in highly branched naphthenic waxes having melting points in the order of 130°–160° F., usually between about 140° and 150° F. While either wax may be used paraffin waxes are generally preferred. Paraffin waxes blend with the natural waxes and animal fats to protect the leather from weathering as well as providing a natural luster to the leather surface.

The animal fats and waxes act as fillers to protect the leather surface from penetration by moisture as well as pollutants and chemicals that may be brought into contact with the leather surface. The luster or shine provided to the leather surface by the waxes helps improve the wearability of the leather as well as improving its appearance.

The non drying characteristics of the oils is in combination with the waxes to insure that the leather remains soft and pliable. The oils and waxes penetrate the surface of the leather thereby forcing foreign materials contained in the leather pores to the surface where they are removed thereby cleaning the leather and protecting it from the adverse affects of dirt, grime and other foreign products.

The compositions of this invention are prepared by separately heating the animal fat and waxes above the respective melting points and heating the oils to a temperature at least as high as the melting point of the highest melting wax being used. Generally these temperatures will vary from about 120°-200° F. The various components are then mixed together with stirring until a homogenious mixture is obtained. The hot mixture is then drained into containers and allowed to solidify. The solidified compositions are in the form of a thick waxy paste and is ready to be applied to the leather. Other additives such as perfumes or essential oils may be added but do not form an essential part of the invention.

It has also been discovered that the compositions of this invention have a medicimal utility and may be used as a salve or ointment in the treatment of skin rashes, callouses and the like.

EXAMPLE

Into one kettle was mixed 10 parts by weight of neat's foot oil, 5 parts by weight of peanut oil, and $1\frac{1}{3}$ parts by weight of olive oil. This mixture was heated to a temperature of approximately 170° F. Into a separate vessel was placed 4 parts by weight of beef tallow which was also heated to the same temperature as the oils. Into the third container was placed 2 parts by weight beeswax and 2 parts by weight of paraffin wax which also was heated to approximately 170° F. The oils, waxes and animal fats were all then combined into a common container and thoroughly mixed by stirring until a homogeneous mixture was obtained. The mixture thus obtained was drained into containers holding 4 fluid ounces and allowed to solidify. In a matter of just a few minutes the liquid in each small container had solidified as a waxy paste.

I claim:

1. A leather treating composition consisting of (a) 30–50 parts by weight of a non-drying oil selected from the group consisting of neatsfoot oil, lard oil and a synthetic or petroleum oil having the same non-drying characteristics as neatsfoot oil and lard oil, (b) 20–30 parts by weight of a non-drying vegetable oil selected from the group consisting of olive oil, peanut oil, almond oil, hazelnut oil and peach kernel oil, (c) 10–20 parts by weight of an animal fat selected from the group consisting of beef tallow, bone fat and mutton tallow, (d) 5–10 parts by weight of a natural wax selected from the group consisting of beeswax, spermaceti, carnuba candelilla and wool fat and (e) 5–10 parts by weight of a paraffin wax.

2. A composition according to claim 1 wherein the animal oil is neat's foot.

3. A composition according to claim 2 wherein the non drying oil is a mixture of olive and peanut oil.

4. A composition according to claim 3 wherein the animal fat is beef tallow.

5. A method of treating and preserving leather goods which comprises applying to the leather goods a composition consisting of, (a) 30–50 parts by weight of a non-drying oil selected from the group consisting of neatsfoot oil,, lard oil and a synthetic or petroleum oil having the same non-drying characteristics as neatsfoot oil and lard oil, (b) 20–30 parts by weight of a non-drying vegetable oil selected from the group consisting of olive oil, peanut oil, almond oil, hazelnut oil and peach kernel oil, (c) 10–20 parts by weight of an animal fat selected from the group consisting of beef tallow, bone fat and mutton tallow, (d) 5–10 parts by weight of a natural wax selected from the group consisting of beeswax, spermaceti, carnuba candelilla and wool fat and (e) 5–10 parts by weight of a paraffin wax.

* * * * *